US008037861B2

(12) United States Patent
Liang

(10) Patent No.: US 8,037,861 B2
(45) Date of Patent: Oct. 18, 2011

(54) ROTARY ENGINE WITH TWO ROTORS AND ITS DESIGN METHOD

(76) Inventor: Liang Liang, Shenzhen (CN)

( * ) Notice: Subject to any disclaimer, the term of this patent is extended or adjusted under 35 U.S.C. 154(b) by 245 days.

(21) Appl. No.: 11/629,836

(22) PCT Filed: Jun. 15, 2005

(86) PCT No.: PCT/CN2005/000853

§ 371 (c)(1),
(2), (4) Date: Dec. 15, 2006

(87) PCT Pub. No.: WO2005/124122

PCT Pub. Date: Dec. 29, 2005

(65) Prior Publication Data

US 2007/0235001 A1 Oct. 11, 2007

(51) Int. Cl.
*F02B 53/00* (2006.01)

(52) U.S. Cl. ..... 123/241; 123/245; 123/43 B; 418/36; 418/37

(58) Field of Classification Search ..... 418/33–38; 123/217, 43 B, 200, 241, 245
See application file for complete search history.

(56) References Cited

U.S. PATENT DOCUMENTS

| | | | | | |
|---|---|---|---|---|---|
| 1,568,051 | A * | 1/1926 | Bullington | 123/245 |
| 2,687,609 | A * | 8/1954 | Mallinckrodt | 418/35 |
| 3,144,007 | A * | 8/1964 | Kauertz | 418/36 |
| 3,798,897 | A * | 3/1974 | Nutku | 60/39.01 |
| 3,989,012 | A * | 11/1976 | Doundoulakis | 123/215 |
| 4,056,339 | A * | 11/1977 | Doi et al. | 418/178 |
| 4,212,271 | A * | 7/1980 | Rigterink | 123/43 B |
| 4,281,628 | A * | 8/1981 | Doundoulakis | 123/245 |
| 4,434,751 | A * | 3/1984 | Pavincic | 123/43 B |
| 5,224,847 | A * | 7/1993 | Kurisu | 418/36 |
| 5,429,085 | A * | 7/1995 | Stauffer | 123/245 |
| 5,501,070 | A * | 3/1996 | Lin | 60/39.34 |
| 5,622,149 | A * | 4/1997 | Wittry | 123/245 |
| 5,992,371 | A * | 11/1999 | Raso | 123/245 |
| 6,113,370 | A * | 9/2000 | Volftsun | 418/38 |
| 6,210,135 | B1 * | 4/2001 | Rassin et al. | 418/36 |
| 6,305,345 | B1 * | 10/2001 | Bakhtine | 123/245 |

* cited by examiner

*Primary Examiner* — Mary A Davis
(74) *Attorney, Agent, or Firm* — Raymond Y. Chan; David and Raymond Patent Firm

(57) ABSTRACT

This invention provides a rotary engine and the type engine design method. This engine mainly has two nested rotors and a cylinder body. This invention publicizes in detail about the rotary engine movement principle and the work mechanism. This type engine can the automatic control compression ratio, the running rate be high, Structure simple and so on many kinds of merits.

8 Claims, 6 Drawing Sheets

ROTARY ENGINE WITH TWO ROTORS AND ITS DESIGN METHOD

BACKGROUND OF THE PRESENT INVENTION

1. Field of Invention

The present invention relates to an engine, and more particularly to a rotary engine comprising a plurality of rotors and its design method.

2. Description of Related Arts

Most conventional combustion engines utilize a plurality of pistons or rotaries for converting power. A major disadvantage of these kinds of conventional combustion engines is that their compression ratio is fixed and cannot be adjusted according to the circumstances in which the engines are used.

Moreover, conventional combustion engines are usually bulky in size and require the use of large flywheels. Furthermore, the mechanical structures of these conventional combustion engines are usually very complex and it is usually very difficult to perform routine maintenance work or repair on them.

On the other hand, conventional rotary engines also have a number of disadvantages. Their compression ratios are also fixed and cannot be adjusted. Moreover, traditional rotary engines have very high fuel consumption.

In order to resolve these disadvantages, two-rotor engines have widely been developed to substitute traditional combustion engines. Prior US patents include:

| Pat. No. and Filing Date | Title |
|---|---|
| U.S. Pat. No. 3,985,110 (Jan. 20, 1975) | Two-Rotor Engine |
| U.S. Pat. No. 6,257,196 (Sep. 07, 1999) | Rotary Disc Engine |
| U.S. Pat. No. 5,433,179 (Dec. 02, 1993) | Rotary Engine with Variable Compression Ratio |
| U.S. Pat. No. 5,622,149 (May 15, 1995) | High-Power Rotary Engine with Varaiable Compression Ratio |
| U.S. Pat. No. 6,293,775 (Jul. 15, 2000) | Small Robust Rotary Internal Combustion Engine having High Unit Power and Low Manufacturing Costs |
| U.S. Pat. No. 6,289,867 (Mar. 10, 2000) | Rotary Engine |

Chinese patent applications include 03136330.9 and 200410049459.7 wherein 200410049459.7 is the prior Chinese patent application claimed by the present application.

These patent applications have made efforts to obtain some breakthrough improvement to rotary engine technology.

SUMMARY OF THE PRESENT INVENTION

The present invention provides a rotary engine, which comprises:

A. an engine housing having a combustion cavity formed therewithin, wherein the engine housing has an exhaust outlet and an air inlet;

B. first and second engine rotors eccentrically and rotatably mounted in the combustion cavity of the engine housing, wherein each of the first and the second engine rotors comprises a plurality of rotor blades spacedly provided within the combustion cavity to divide the combustion cavity into four combustion chambers;

C. a fuel-supply device;

D. a support structure, which comprises:

E. an actuation device for transferring an externally applied force to the first and the second engine rotors for initiating a rotation thereof in a predetermined direction;

F. a locking device for preventing one or both of the engine rotors from rotating against the predetermined direction;

G. a sealing device;

H. a cooling device;

M. a lubricating device;

According to one preferred embodiment to enhance a stability of the rotary engine, a mass of the first engine rotor is greater than a mass of the second engine rotor, wherein the locking device is coupled with the second engine rotor. The fuel-supply device can be embodied as a carburetor or an electrically connected injector etc., wherein the fuel of the rotary engine can be embodied as gaseous fuel or liquefied fuel.

The actuation device comprises a power device connected with the second engine rotor so as to transfer a rotational force thereto, wherein the support structure further comprises a power output device connected with the first engine rotor for outputting power thereto.

The actuation device further comprises a rotor locker coupled with the first and the second engine rotor to temporarily lock up one of the first and the second engine rotor, wherein when unlocked engine rotor rotates to a predetermined unlocked location, the locked engine rotor is unlocked, while the originally unlocked rotor is subsequently locked until the unlocked engine rotor moves to the predetermined position again.

The rotor locker is thus capable of initially locking one of the first and the second engine rotor, wherein the unlocked engine rotor is arranged to unlock the locked engine rotor when it is rotated to the predetermined unlocked position. At that moment, the originally locked engine rotor is then unlocked while the originally unlocked engine rotor is then locked. The subsequently locked engine rotor can then be unlocked by rotating the subsequently unlocked engine rotor to the predetermined unlocked position.

The above locking feature of the rotor locker is applicable in the initialization stage of the rotary engine. When the rotational speed of the first and the second engine rotor reach a predetermined threshold, the rotor locker ceases to function.

The actuation device comprises a coupling arrangement which comprises a first and a second actuating member coupled with the first and the second engine rotor respectively, wherein the power device of the actuation device or an external power source arrangement is arranged to sequentially exert a rotational force to the first engine rotor via the first actuating member to drive the first engine rotor to rotate toward the second engine rotor which is locked by the rotor locker for compressing the air and fuel between the first engine rotor and the second engine rotor, and to exert a rotational force to the second engine rotor via the second actuating member to drive the second engine rotor (when unlocked by the rotor locker) to rotate toward the first engine rotor which is subsequently locked by the rotor locker for compressing the air and fuel between the first engine rotor and the second engine rotor.

The above-mentioned locking device may be embodied as a gear member, wherein the gear member is a complete gearing member or an incomplete gearing member.

Moreover, the locking device further comprises an electromagnetic device comprising an electromagnet and a metallic element coupled with the first and the second engine rotor, such that when each of the first and the second engine rotor rotates toward each other for air and fuel compression, electric current is applied to the electromagnet for inducing a corresponding magnetic force to the corresponding metallic element so as to prevent the first and the second engine rotor from rotating in a reverse direction. When a combustion cycle is completed, the electromagnetic device is deactivated.

The engine housing further has a buffering cavity formed along an inner sidewall of the engine housing at a position in a vicinity of the air inlet. The engine housing further has a gas feedback channel formed therein, wherein a length of the gas feedback channel is greater than a width of the first and the second engine rotor, wherein high pressure gas after the combustion is arranged to be directed back to mix with gas and fuel mixture which have not been combusted in the combustion chamber. Furthermore, the rotary engine further comprises a fuel injector provided in the engine housing in the vicinity of the exhaust outlet within the gas feedback channel.

The combustion cavity can be divided into an upper combustion chamber and a lower combustion chamber. Alternatively, the combustion cavity can be divided radially to form a number of combustion chambers.

The design of the rotary engine comprising a engine housing of the present invention can be accomplished through the steps of:

Step 1: ascertaining an optimal compression ratio;

Step 2: ascertaining, depending on an output power and rotational speed, a mass and width of each of a first engine rotor and a second engine rotor;

Step 3: ascertaining, depending on said optimal compression ratio and said width of said first and said second engine rotor, a distance between an air inlet and an exhaust outlet; and Step 4: ascertaining a position of a fuel injector and an ignition device in the engine housing;

The present invention also provides a method of controlling a rotational speed of a first and a second engine rotor of a rotary engine, comprising the steps of:

Step K1: preventing a rotational power of power device to be delivered to the first engine rotor by a rotor locker and the locking device;

Step K2: driving, by the power device, the second engine rotor to rotate toward the first engine rotor for compressing air and fuel between the first engine rotor and the second engine rotor;

Step K3: repetitively igniting the air and the fuel between the first engine rotor and the second engine rotor so as to create a series of combustions within the combustion chamber, wherein a first combustion is arrange to drive the second engine rotor to rotate to the predetermined position for unlocking the first engine rotor and locking the second rotor, wherein a second combustion is arranged to drive the first engine rotor for unlocking the second engine rotor and locking the first engine rotor;

Step K4: stabilizing the operation of the rotary engine for a predetermined period of time.

DETAILED DESCRIPTION OF THE PREFERRED EMBODIMENT

The following description describes the present invention in greater details.

Figure 1:
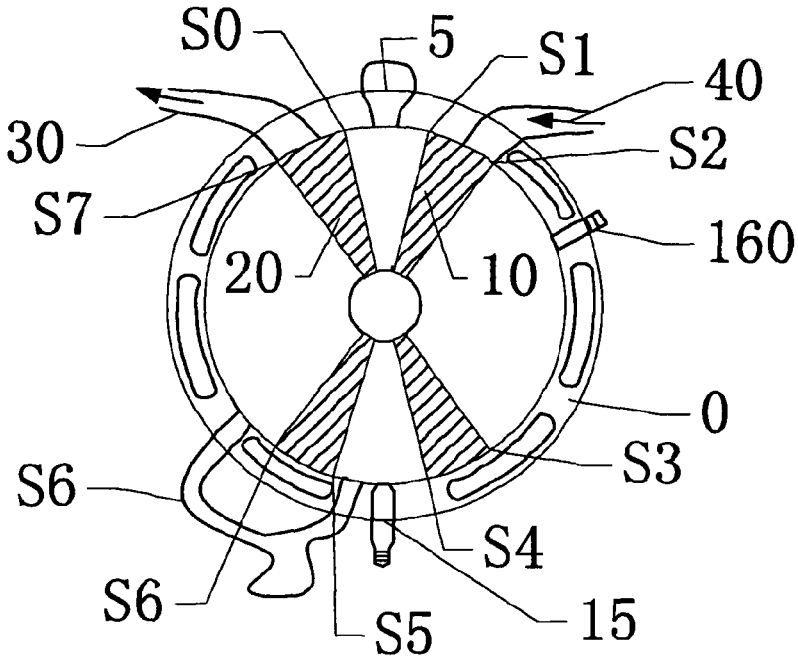
FIG. 1 is a schematic diagram of a rotary engine according to a preferred embodiment of the present invention.

Referring to FIG. 1 of the drawings, a rotary engine according to a preferred embodiment comprises an engine housing 0 having a combustion cavity formed therein, a first engine rotor 10, a second engine rotor 20, an exhaust outlet 30, and air inlet 40, wherein the engine housing 0 has a buffering cavity 5 formed between the exhaust outlet 30 and the air inlet 40. The operation of the rotary engine requires consistent and stabilized compression of fuel and air to achieve optimal combustion. During a typical operation of the rotary engine, the following problems may occur:

1. In between the exhaust outlet 30 and the air inlet 40, fresh air and exhaust air may be mixed together.

2. In initialization stage of the rotary engine, the first and the second engine rotor 10, 20 may overlap and align with each other. It is relatively difficult for the power device to drive one of them in order to accomplish fuel and air compression.

One may resolve the above problems by allowing the exhaust outlet 30 and the air inlet 40 to directly connect to the ambient air. However, this solution does not allow the utilization of exhaust gas pressure to assist subsequent combustions. The provision of a buffering cavity can substantially resolve the above mentioned problem.

FIG. 2 illustrates the change of the rotational speed of the first and the second engine rotor for a predetermined period of time, wherein the first and the second engine rotor have equal mass. As shown in the drawings, for each of the first and the second engine rotors 10, 20, there exist a minimum rotational speed and a maximum rotational speed. Where the mass of the first and the second engine rotors 10, 20 is the same, their respective change of rotational speed would be the substantially same. A user of the present invention must effectively control the input of fuel and output power in order to allow effective and stable combustion so as to ensure the relative movement of the first and the second engine rotor 10, 20 to be optimal. According to the preferred embodiment of the present invention, the preferred rotational speed of the first and the second engine rotors 10, 20 is such that when the first engine rotor 10 moves from S2 to S4 (in FIG. 1), the second engine rotor 20 moves from S4 to S6.

As shown in FIG. 1 of the drawings, the optimal compression ratio is a function of a width of the exhaust outlet 30 and air inlet 40, a width of the first and the second engine rotors 10, 20, and position of the ignition device and the time of ignition. When the ignition device, which is positioned at S5, keeps on igniting the gas-fuel mixture within the combustion cavity, and if the compression ratio of the rotary engine is S2S3 over S4S5, varying a width of the first and the second engine rotors 10, 20 may alter the maximum and minimum rotational speed of them. The greater the width of the first and the second engine rotors 10, 20, the smaller the ratio of maximum rotational speed to minimum rotation speed of the respective engine rotor. However, the greater the width of a particular engine rotor, the smaller the gas intake for a particular rotation cycle.

Under the operation condition of the rotary engine in which a load is changing from time to time, it is difficult to maintain the optimal compression ratio which requires the detection of the rotation speed and position of the first and second engine rotor respectively, the effective control of the fuel and the air, the time of ignition and the detection of change of load and the ability to predict the change of the operation condition. As a result, all the above technical problems have to be solved and the cost is high.

In order to solve the above problems, the present invention provides a locking device in operation with the first and second engine rotors. As shown in FIG. 2B of the drawings, the change of the rotational speed of the first and the second engine rotors is illustrated. In one particular rotational cycle, the speed of the first and the second engine rotor during two intervals of time is 0, while the intervals of time at a zone zero is changed according to the changes of power and loading such that the pattern as shown is automatically achieved.

As shown in FIG. 2B of the drawings, the range of change of the rotational speed of the first and the second engine rotor is great. In order to stabilize the speed output, the engine rotor is connected to an incomplete gearing member, defining a gearing portion and a non-gearing portion, of the locking device to drive an output gear, wherein the output gear has increased the mass and hence inertia for flywheel which is a kind of stabilized rotation such that a constant power output is obtained.

As shown in FIG. 2B of the drawings, the frequency and extent of the change of the rotational speed of the first and the second engine rotor are great in magnitude. Therefore, highly effective and high standard of parts, fuel-supply system, power transmission system and initiation system are required which impose great difficulties in the design of rotary engine.

The present invention has successfully solved the above problems by providing two engine rotors, which is the first and the second engine rotor, having a different mass. The mass of one engine rotor is greater than the mass of another engine rotor. In the description below, the two engine rotors are namely the engine rotor having a greater mass and the engine rotor having a smaller mass. When the first engine rotor is the engine rotor having a greater mass, then the second engine is the engine rotor having a smaller mass, and vice versa. To achieve a mass difference between the two engine rotors, a width of the two engine rotors may be the same or different. When the width of the two engine rotors are the same, the engine rotor having an engine body defining a functional portion and a non-functional portion may remove the mass from the non-functional portion without affecting the functioning thereof so as to reduce the mass of the engine rotor, for example, a hollow engine body, or the engine rotor may carry an additional weight to increase its mass. The locking device is provided on the engine rotor having a smaller mass which is coupling with the engine rotor having a greater mass to provide power output.

Figure 3A:
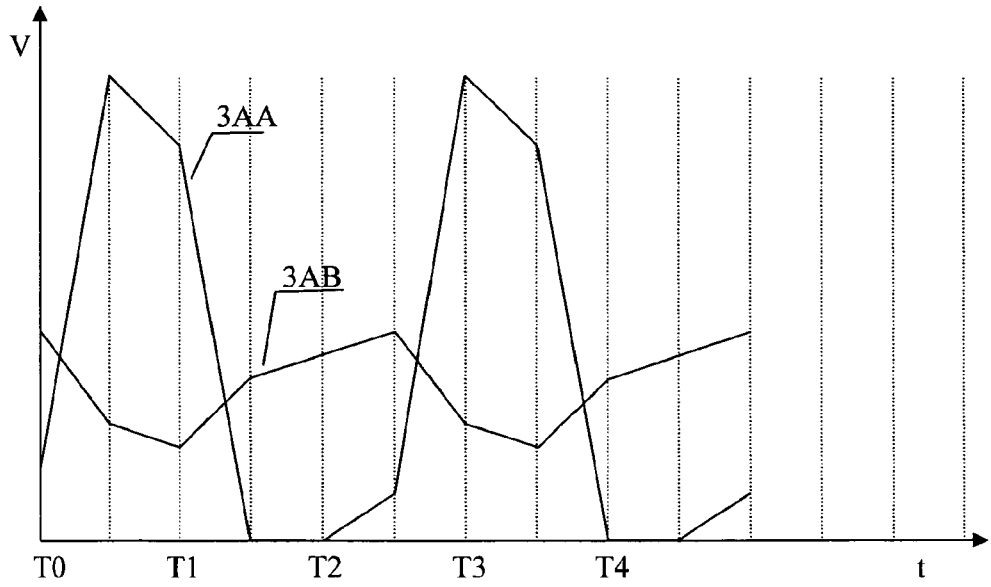
FIG. 3A illustrates the change of the rotational speed of the first and the second engine rotor for a predetermined period of time, wherein the first and the second engine rotor have different mass.

According to the law of conservation of momentum, if the same force is acted on two objects having different mass, the rate of change of velocity of the lighter object is greater than that of the heavier object. As shown in FIG. 3 of the drawings, the line 3AA illustrates the change of the rotational speed of the engine rotor having a smaller mass while the line 3BB illustrates the change of the rotational speed of the engine rotor having a greater mass. When the relative mass difference of the two engine rotors is increased, the change of the rotational speed of the engine rotor having a greater mass will be reduced while the change of the rotational speed of the engine rotor having a smaller mass will be increased.

The engine rotor having a greater mass will have a smaller change of rotational speed while the engine rotor having a smaller mass will have a greater change of rotational speed. The engine rotor having a greater mass is capable of having the Flywheel Effect. The power output can be used to drive the engine rotor having a greater mass but it is also possible to use the power output on the engine rotor having a smaller mass to provide a very high rotational speed under different operation condition.

The engine rotor having a greater mass is stable and has a relatively small change of rotational speed and so can be used as a power output rotor. The engine rotor having a smaller mass is capable of increasing or decreasing the rotational speed easily and providing a fast locking support to increase the speed of the engine rotor having a greater mass and the power output under the operation with the locking device.

In practice, the load is treated as a mass of the engine rotor and the mass ratio of the two engine rotors is not constant. When the load is on the mass of the engine rotor having a greater mass, it is equivalence to the addition of the mass of the engine rotor having a greater mass.

Figure 3B:
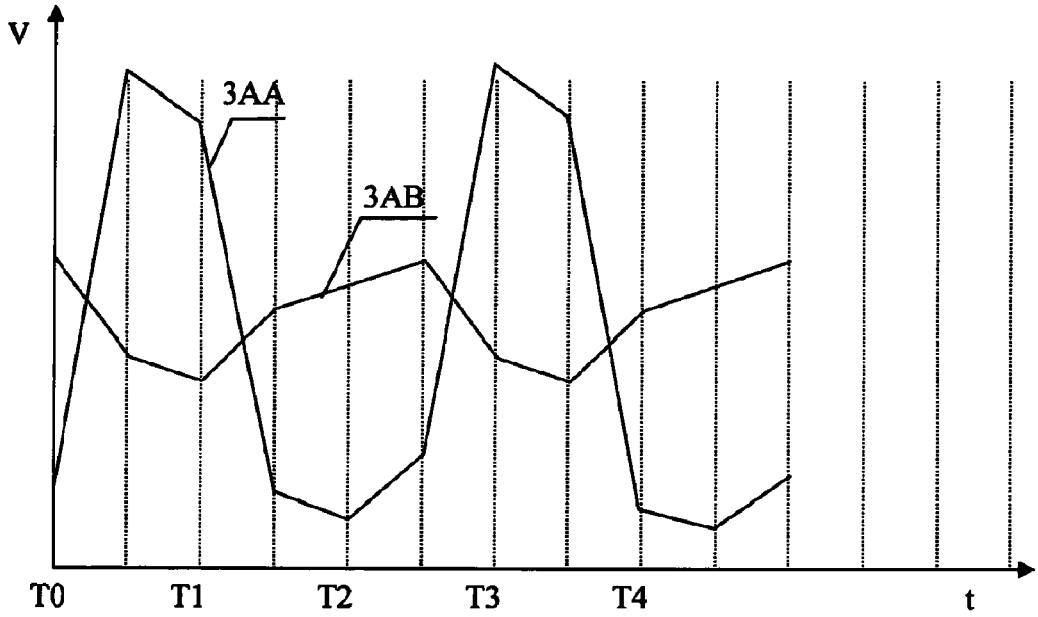
FIG. 3B illustrates the change of the rotational speed of the first and the second engine rotor for a predetermined period of time, wherein the first and the second engine rotor have different mass and operating at high rotational speed.

When the output speed and the power are changed, the change of rotational speed of the engine rotor having a smaller mass will be changed accordingly, which is illustrated as in FIG. 3B of the drawings. When the speed of the rotary engine is increased, the line pattern will have a shorter cycle in a particular period of time and a greater magnitude of change of rotational speed. That is to say, a greater output speed of the rotary engine is obtained.

When the load on the engine rotor having a greater mass is changed, in order to maintain the rotational speed of the engine rotor having a smaller mass, the mass of the engine rotor having a smaller mass can be adjusted accordingly, that an additional load can be interactive coupled to an axis of the engine rotor having a smaller mass.

Figure 4A:
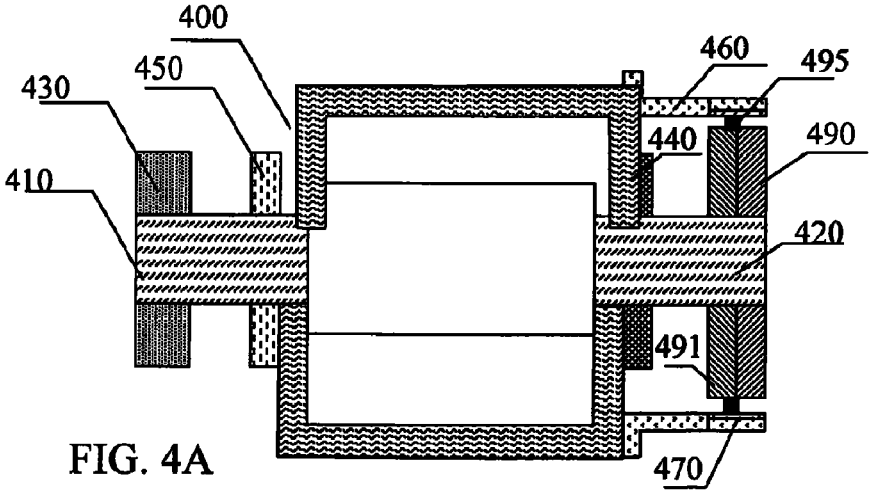
FIG. 4A is a side view of the rotary engine according to the preferred embodiment of the present invention.

Referring to FIG. 4A of the drawings, the present invention according to the preferred embodiment comprises an engine housing 400, a power output device 430 operating with the engine rotors having a greater mass, a rotor locker 450 operating with the engine rotors having a greater mass, a locking device 440 operating with the engine rotors having a smaller mass, and a coupling arrangement of the actuation device 491~499.

Figure 4B:
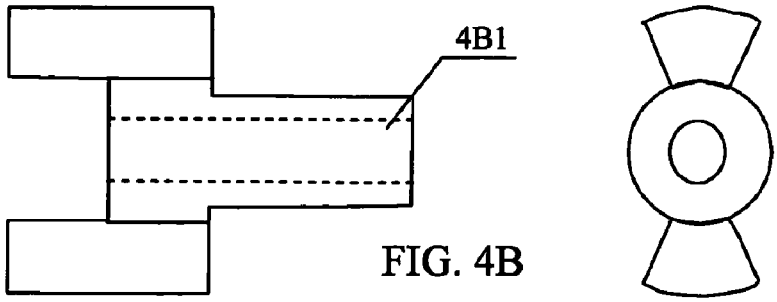
FIG. 4B is a schematic diagram of the rotary engine according to the above preferred embodiment of the present invention.
Figure 4C:
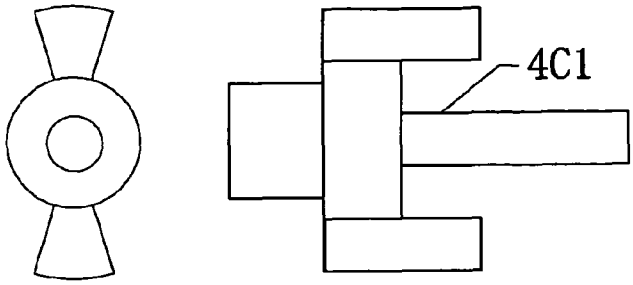
FIG. 4C is a schematic diagram of another exemplary embodiment of the rotary engine according to the above preferred embodiment of the present invention.

The engine housing 400 has a cylinder body, which can be embodied as a cylinder and divided by different engineering methods such as radially through the axis of the cylinder body or through the top and bottom portion of the cylinder body. Referring to FIG. 4B and FIG. 4C, two engine rotors are illustrated, wherein each engine rotor can also be divided by different methods. As shown in FIGS. 4B and 4C of the drawings, the two engine rotors are eccentrically connected and a combustion cavity as defined by the engine housing 400 is divided into four combustion chambers. The engine rotor as shown in FIG. 4B has a cavity 4B1 while the engine rotor as shown in FIG. 4C has an axis 4C1 which is capable of extending outwardly to a coupling arrangement of the actuation device 490.

Figure 4D:
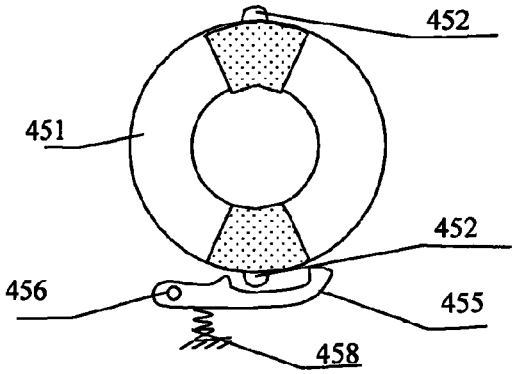
FIG. 4D is a schematic diagram of the rotor locker according to the above preferred embodiment of the present invention.

Referring to FIG. 4D of the drawings which is a schematic diagram of the rotor locker, wherein a protruded portion 452 is formed on an actuating member 451 connecting with the engine rotor 410. When the protruded portion 452 is rotated towards a lock member 455, the protruded portion 452 is locked into a locking position with limited movement. The lock member 455 is also in operation with a resilient element 458 such as a spring. The lock member 455 is rotated with an axis 456. When the force on the actuating member 451 has reached a predetermined level, the lock member 455 can be unlocked into an unlock position. The rotor locker can also be designed to have the unlock position during rotation and the locking position during actuation such that the fiction of the engine rotor during the operation of the rotary engine can be reduced.

The rotor locker can also have other alternatives. As shown in FIG. 1 of the drawings, when the engine rotor 10 is rotated to the position S6, the engine rotor 20 is unlocked. When the engine rotor 20 is rotated to the position S6, the engine rotor 10 is unlocked. Thus, through the repeated operation of the engine rotor 10 and the engine rotor 20, the rotor locker can make use of the mechanical movement which is the cam drive movement or make use of the solenoid with the position detecting method by electromagnetic force.

Figure 4E:
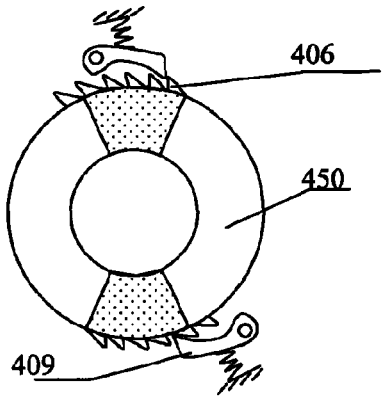
FIG. 4E is a schematic diagram of the locking device according to the above preferred embodiment of the present invention.

FIG. 4E illustrates the locking device according to the above preferred embodiment of the present invention. A gear member of the locking device 450 operated on the engine rotor having a smaller mass 420 is a type of incomplete gear. The locking device includes an incomplete gearing member 406, wherein the gear member of the locking device 450 can only be rotated in a clockwise direction when operated with a gear lock member 409.

As shown in the shading area of FIG. 4D and FIG. 4E, both the protruded portion 452 and the incomplete gearing member 406 have a position corresponding to the rotor blades of the engine rotor.

Figure 7:
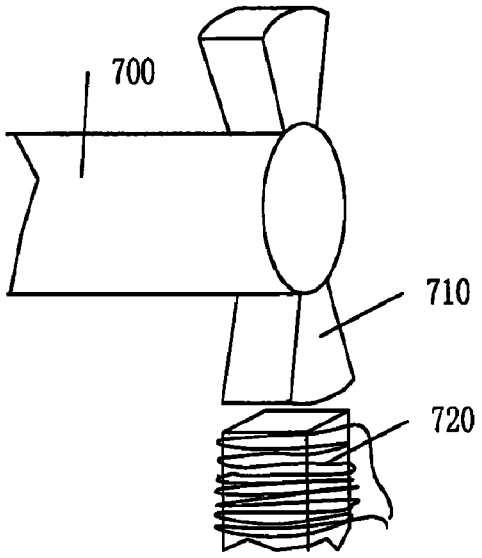
FIG. 7 is a schematic diagram of the locking device according to the above preferred embodiment of the present invention, illustrating an electromagnetic principle for locking the first and the second engine rotor.

Other alternative arrangement for the locking device may be employed such as those used in the wheel of a bicycle. As shown in FIG. 7, a locking device using an electromagnetic principle is illustrated, which comprises a metallic element 710 connected to the axis 700 of the engine rotor and an electromagnet 720. The rotation of the engine rotor moves the metallic element 710 to a position corresponding to the position of the electromagnet 720, the electromagnet 720 is electrically connected and the metallic element 710 is attracted, then work is done inside the engine housing and the electromagnet 720 is no longer conductive after the work is done. Therefore, the engine rotor can resume rotational movement. The use of electromagnetism in the locking device provides flexibility and convenience which also eliminates mechanical loss and mechanical noise. At the same time, this type of locking device can be used to further combine with motors and generators, connect to external power source and assemble to a highly integrated hybrid power engine.

Figure 4F:
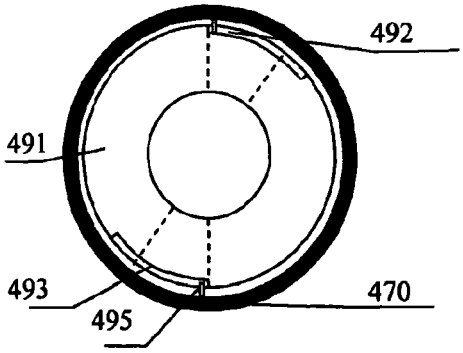
FIG. 4F to FIG. 4G is schematic diagrams of the coupling arrangement according to the above preferred embodiment of the present invention.
Figure 4G:
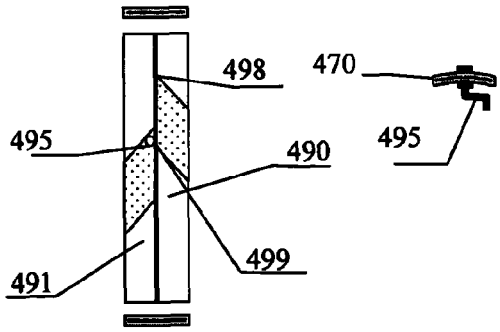

Referring to FIG. 4F and FIG. 4G of the drawings, a coupling arrangement of the actuation device 490 according to the preferred embodiment of the present invention comprises a first actuating member 490 and a second actuating member 491, eccentrically connected to the engine rotor 420 respectively, such that said first and second actuating members 490, 491 are connected to the engine rotor 410.

As shown in FIG. 4F, the first and second actuating member 490, 491 further define a first guiding groove 492 and a second guiding groove 493 which include a bevel angle respectively, a switch 495 which is capable of being guided therewithin, and a wheel 470 capable of initiating the rotational movement of the switch 495. When the wheel 470 initiates the movement of the switch 495, the switch 495 actuates the movement of the second actuating member 491 toward the position as shown in FIG. 4G (The shading area in FIG. 4G is the position of the guiding groove.) At this point, a starting point 495 of the guiding groove in the second actuating member 491 and an end point 499 of the guiding groove in the first actuating member 490 is overlapped and interlocked. Under the effect of the beveled angle of the guiding groove, the switch slides into the guiding groove of the first actuating member 490 and to the starting point 498 of the guiding groove of the first actuating member 490 and brings the first actuating member 490 into rotational movement. The shading area as shown in FIG. 4F illustrates the position of the guiding grooves corresponding to the rotor blades of the engine rotor respectively.

During the actuation process, the engine rotor having a greater mass is locked by the locking device. With the power provided by the external power source arrangement, the engine rotor having smaller mass starts gaseous compression, wherein the engine rotor having a smaller mass is in operation with the locking device and therefore do not require the operation of lock rotor for locking its position, then the gas is exploded or is ignited by the ignition device, pushing the engine rotor having a greater mass with a force which is great enough to unlock the lock member 455, and provide gaseous compression in a reverse direction, such that gaseous compression is provided continuously. If the combustion is incomplete, or if the gaseous compression is not continuous, the coupling arrangement of the actuation device is initiated to push the engine rotor having a greater mass to rotate forward to provide the next compression.

In practice, the rotary engine of the present may not include a coupling arrangement of the actuation device and may or may not include a locking device. Instead, with the fuel injection and ignition, an external force is directly exerted on one engine rotor and actuates the movement of the engine rotor. This type of actuation requires an external force to increase the speed of one engine rotor dramatically in a short period of time, wherein a mixture of fuel and air in compression form between the two engine rotors is formed between S3~S6 of the engine housing, and that the actuating device is capable of being reversed to separate the coupling engine rotors, which can be achieved by the use of motor and microcomputer control method together with the detection of the position of the coupling engine rotor.

Figure 6:
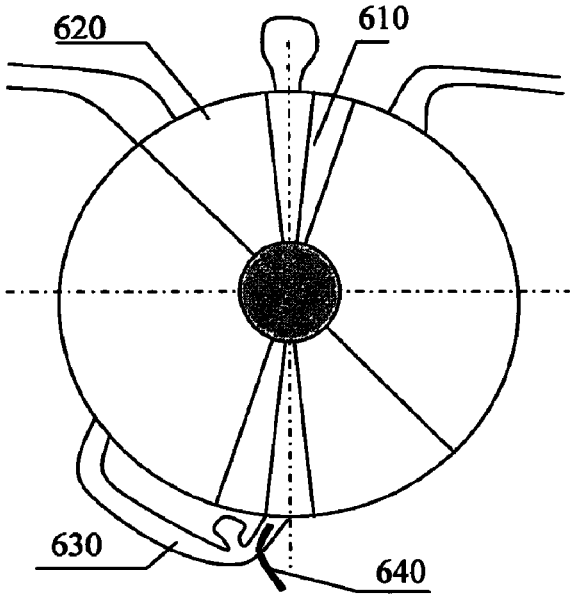
FIG. 6 is a schematic diagram the first and the second engine rotor according to the above preferred embodiment of the present invention, where a width of the first engine rotor is different from a wide of the second engine rotor.

Referring to FIG. 6, a first engine motor 610, a second engine motor 620 and a feedback channel 630 which is under high temperature and high pressure condition are illustrated. The feedback channel is capable of directing the high temperature combustion gas back to the gaseous compression area which 25 contains the compression gas for combustion. During the operation of the rotary engine, the high temperature combustion gas is arranged to direct back to ignite the compression gas for combustion such that a constant ignition point is maintained while the compression ratio is increased with the use of the exhausted gas.

The fuel injector 640 is provided in the feedback channel, that the instantaneous feedback gas is capable of increasing the vaporization rate.

The feedback channel further defines a portion of expansion area such that a mass of the feedback gas is increased and a forward feedback level is limited.

Figure 5A:
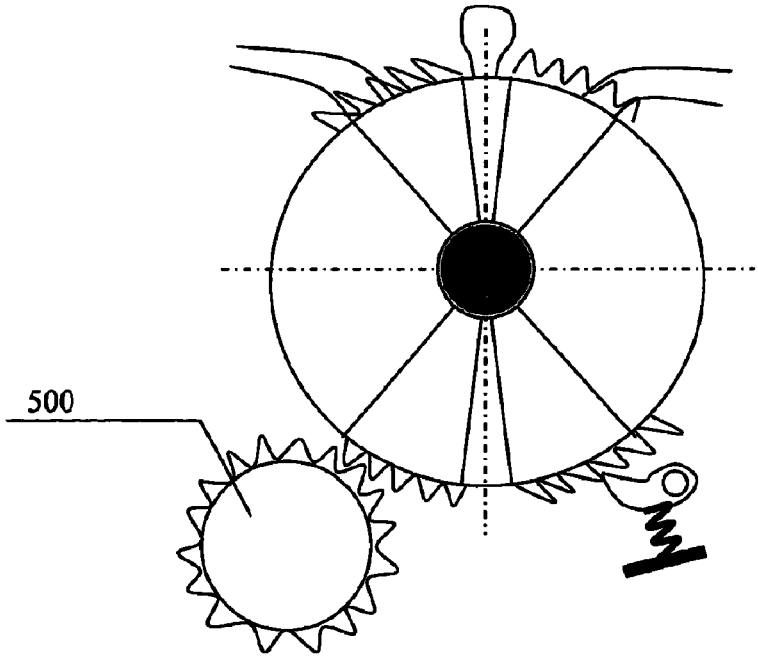
FIG. 5A is a first schematic diagram the rotary engine according to the above preferred embodiment of the present invention.
Figure 5B:
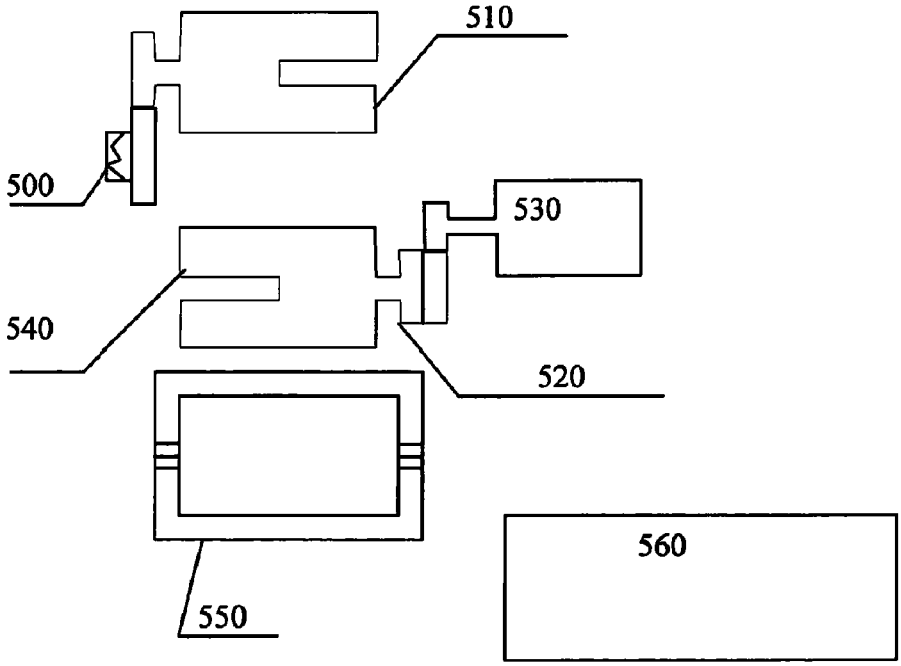
FIG. 5B is a second schematic diagram the rotary engine according to the above preferred embodiment of the present invention.

As shown in FIGS. 5A and 5B, another alternative of the preferred embodiment of the present invention showing the output gear 500 of the power output device of the rotary engine and the locking device. The output gear as shown is coupled with the engine rotors at a coupling position at which the other end of the air inlet is covered. The incomplete gearing member is used for coupling such that the speed of the power output gear is constant. The locking device is also coupled through an incomplete gear mechanism such that the fictional effect of the locking device upon the engine rotor is reduced.

In the design concerning a position of the power output gear, the point of combustion together with the output speed area should be considered. In general, the power output gear is positioned at the point of combustion and comprises an incomplete gearing member, wherein when the engine rotor is rotated to the point of combustion, the incomplete gearing member will couple with the output gear. As shown in FIG. 5A, the engine rotor drives the output gear for two times in one particular cycle of the engine rotor.

Figure 2A:
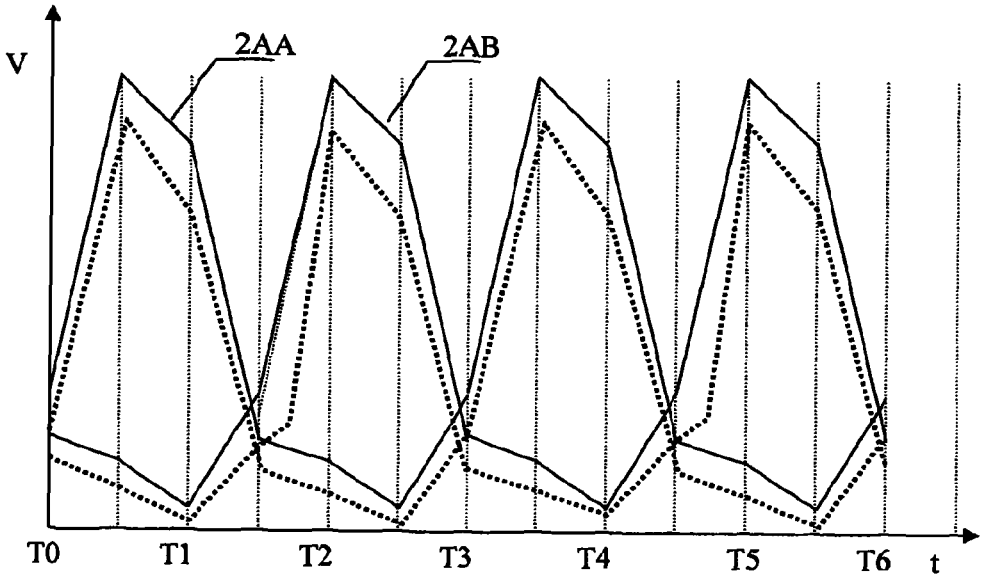
FIG. 2A illustrates the change of the rotational speed of the first and the second engine rotor for a predetermined period of time, wherein the first and the second engine rotor have equal mass.
Figure 2B:
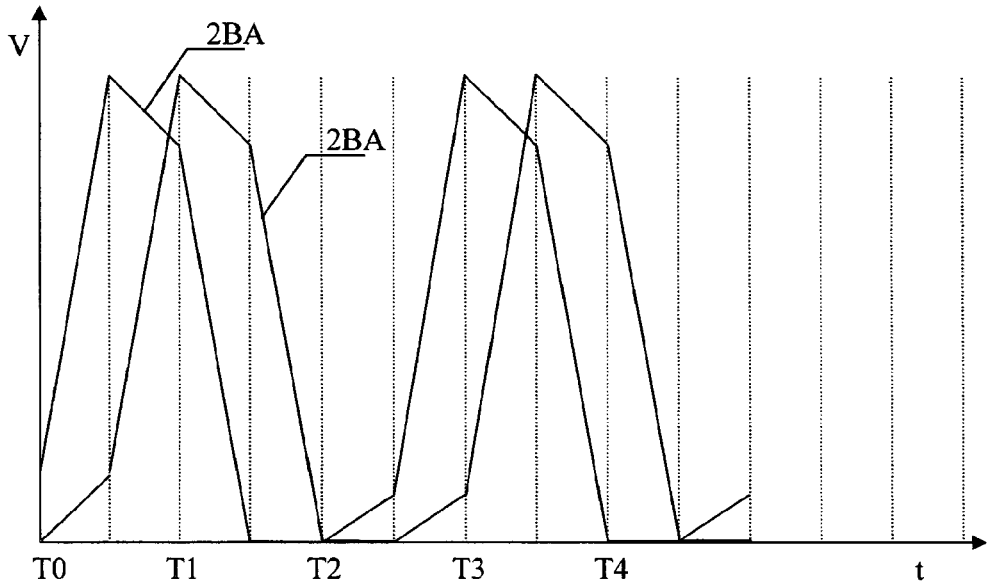
FIG. 2B illustrates the change of the rotational speed of the first and the second engine rotor as locked by the rotor lockers for a predetermined period of time, wherein the first and the second engine rotor have equal mass.

As shown in FIG. 2A, after the power output is obtained, the change of rotational speed will be changed according to the phantom line as shown in the drawings.

As shown in FIG. 5B, the rotary engine mainly comprises an engine housing 550, an engine rotor having a greater mass 510, an engine rotor having a smaller mass 540, an actuation device 530, a locking device 520 and a frame structure 560.

The frame structure 560 provides support to other parts, such as the engine housing 550 in FIG. 5B, of the present invention. Since the rotary engine of the present invention does not involve a piston with upward and downward motion, the engine housing 550 is designed to have two portions, wherein each portion has an opening which is convenience for installation and repair.

The present invention also provides a method of controlling a rotational speed of a first and a second engine rotor of a rotary engine, with the use of the locking device or the coupling position of the power output gear, and digital control ignition method to digitally control the change of rotational speed, wherein the method comprises the steps of:

Step K1: preventing a rotational power output to be delivered to the first engine rotor by the use of a rotor locker or the use of fiction between the output gear and incomplete gearing member;

Step K2: driving the second engine rotor to rotate toward the first engine rotor for compressing air and fuel between the first engine rotor and the second engine rotor to define a temporary stable condition of initiation;

Step K3: repetitively igniting the air and the fuel between the first engine rotor and the second engine rotor so as to create a series of combustions within the combustion chamber which is defined as a temporary stable condition of operation, wherein a first combustion is arrange to drive the second engine rotor to rotate to the predetermined position for unlocking the first engine rotor and locking the second rotor, wherein a second combustion is arranged to drive the first engine rotor for unlocking the second engine rotor and locking the first engine rotor;

Step K4: maintaining the temporary stable condition of operation for a predetermined period of time according to the required rotational speed of the engine and repeating Step K3.

The important structure of the present invention is disclosed above and the steps for the operation of the present invention are further provided so as to accomplish the rotary engine of the present invention as follows:

Step 1: ascertaining an optimal compression ratio;

wherein the optimal compression ratio can be determined by the fuel being used, eg. 10 or 15, etc. The compression ratio of the rotary engine of the present invention is not constant but is fluctuated within a range. The value of compression ratio P has to be determined according to the property of the fuel being used. For example, P=20.

Step 2: ascertaining, depending on an output power and rotational speed, a mass of each of a first engine rotor and a second engine rotor M1 and M2, to ascertain a power output position, for example, M1/M2=20;

The power and rotational speed of the engine is determined by the need. For example, if the need is an output of one horsepower, the rotational speed is 600 rpm. After the rotational speed and power are obtained, the mass of the engine rotor can be determined. Based on the compression ratio, create the heat equation and kinetic energy equation of the engine rotor to obtain the mass and width of the engine rotor.

The mass of the two engine rotors is ascertained by the value of the ratio of the mass of the engine rotor having a greater mass to the mass of the engine rotor having a smaller mass, which is M1/M2, the greater the value of M1/M2, the greater the output speed of the engine rotor having a greater mass and the engine will be more easily controlled. However, the greater the change of speed of the engine rotor having a smaller mass, the requirement of the material and processing of the engine rotor having a smaller mass will be higher. Generally speaking, M1/M2 is in a range between 10 and 100 and the ratio M1/M2 is capable of being adjusted through the change of the mass of the engine rotor having a smaller mass by interactive coupling method.

It should be noted that, while determining a width of the engine rotor, a value of the width of the engine rotor cannot be too small but is to be determined based on the compression ratio. The greater the compression ratio, the greater is the width. The smaller the compression ratio, the smaller is the width. Generally speaking, the width of the engine rotor is set to be approximately ⅛ of the circumferential length of the cylinder. S3~S6, which is the sum of the width of the two engine rotors and the minimum width of the compression gas, is approximately ⅙-¼ circumferential length of the cylinder.

Step 3: ascertaining, depending on said optimal compression ratio and said width of said first and said second engine rotor, a distance between an air inlet and an exhaust outlet;

wherein a width of the engine rotor D is ⅛ circumferential length of the cylinder;

S3S2+D+S4S5+D=½ circumferential length of the cylinder;

S3S2/S4S5=P=20; therefore S3S2=1/48 circumferential length of the cylinder, S4S5=20/48 circumferential length of the cylinder;

Then the distance between air inlet and exhaust outlet=S3S2+¼=13/48 circumferential length of the cylinder.

Step 4: ascertaining a position of a fuel injector and an ignition device in the engine housing.

After ascertaining the distance between air inlet and exhaust outlet, the position of the ignition device is determined as a position of the air inlet corresponding to approximately the original position of the engine housing. The fuel injector is at a position between the air inlet from which the engine rotor rotates and the ignition device.

In one of the embodiment of the present invention, the ignition device is not necessary and the fuel is ignited automatically under high pressure and high temperature condition.

The rotary engine with rotors and its design method of the present invention is fully described above. One skilled in the art will understand that the embodiment of the present invention as shown in the drawings and described above is exemplary and illustrating only, and the actual value of the change of speed is subject to change without departure from the principles of the present invention.

The present invention neither provides a sealing structure or arrangement between the engine housing and the engine rotor, or between the two engine rotors; nor other technical features such as cooling or lubricating device or arrangement. One skilled in the art should be able to apply the related arts concerning the sealing, cooling and lubricating structure or arrangement existing in the field, many of which is disclosed in patent applications related to two-rotor engine, to the present invention.

It will thus be seen that the objects of the present invention have been fully and effectively accomplished. The embodiments have been shown and described for the purposes of illustrating the functional and structural principles of the present invention.

What is claimed is:

1. A rotary engine, which comprises:

an engine housing having a combustion cavity formed therewithin, wherein said engine housing has an exhaust outlet and an air inlet;

first and second engine rotors concentrically and rotatably mounted in said combustion cavity, wherein each of said first and said second engine rotors comprises a plurality of rotor blades spacedly provided within said combustion cavity to divide said combustion cavity into four combustion chambers;

a fuel-supply device communicated with said engine housing for supplying a predetermined amount of fuel; and a support structure, which comprises:

an actuation device for transferring an externally applied force to said first and said second engine rotors for initiating a rotation thereof in a predetermined direction, wherein said actuation device comprises:

a power device connected with said second engine rotor to transfer a rotational force thereto; and a rotor locker coupled with said first and said second engine rotor to temporarily lock up one of said first and said second engine rotor, wherein when said unlocked engine rotor rotates to a predetermined unlocked location, said locked engine rotor is unlocked, while said originally unlocked rotor is subsequently locked by said rotor locker until said unlocked engine rotor moves to said predetermined position again, wherein said rotor locker is arranged to lock one of said first and said second engine rotors when said rotary engine is an initialization stage, so that when said rotational speed of said first and said second engine rotor reaches a predetermined threshold, said rotor locker ceases to function;

a power output device connected with said first engine rotor for outputting power thereto; and a locking device which is arranged to prevents at least one of said engine rotors from rotating against said predetermined direction, and comprises an electromagnetic device comprising an electromagnet and a metallic element coupled with said first and said second engine rotor, such that when each of said first and said second engine rotor rotates toward each other for air and fuel compression, electric current is applied to said electromagnet for inducing a corresponding magnetic force to said corresponding metallic element so as to prevent said first and said second engine rotor from rotating in a reverse direction, wherein a mass of said first engine rotor is greater than a mass of said second engine rotor, and said locking device is coupled with said second engine rotor, wherein said second engine rotor is capable of increasing or decreasing a rotational speed easier than the first engine rotor.

2. The rotary engine, as recited in claim 1, wherein said actuation device further comprises a coupling arrangement which comprises a first and a second actuating member coupled with said first and said second engine rotor respectively, wherein said power device is arranged to sequentially exert a rotational force to said first engine rotor via said first actuating member to drive said first engine rotor to rotate toward said second engine rotor which is locked by said rotor locker for compressing air and fuel between said first engine rotor and said second engine rotor at said corresponding combustion chamber, and to exert a rotational force to said second engine rotor via said second actuating member to drive said second engine rotor, when unlocked by said rotor locker, to rotate toward said first engine rotor which is subsequently locked by said rotor locker for compressing said air and said fuel between said first engine rotor and said second engine rotor at said corresponding combustion chamber.

3. The rotary engine, as recited in claim 2, wherein said engine housing further has a buffering cavity formed along an inner sidewall of said engine housing at a position in a vicinity of said air inlet, and a gas feedback channel formed therein, wherein a length of said gas feedback channel is greater than a circumferential length of said first and the second engine rotor, wherein high pressure gas after combustion is arranged to be directed back to mix with gas and fuel mixture which is not combusted in said corresponding combustion chamber.

4. The rotary engine, as recited in claim 3, further comprising a fuel injector provided in the engine housing in a vicinity of said exhaust outlet within said gas feedback channel.

5. The rotary engine, as recited in claim 2, further comprising a fuel injector provided in the engine housing in a vicinity of said exhaust outlet within said a gas feedback channel.

6. The rotary engine, as recited in claim 1, wherein said engine housing further has a buffering cavity formed along an inner sidewall of said engine housing at a position in a vicinity of said air inlet, and a gas feedback channel formed therein, wherein a length of said gas feedback channel is greater than a circumferential length of said first and the second engine rotor, wherein high pressure gas after combustion is arranged to be directed back to mix with gas and fuel mixture which is not combusted in said corresponding combustion chamber.

7. The rotary engine, as recited in claim 6, further comprising a fuel injector provided in the engine housing in a vicinity of said exhaust outlet within said gas feedback channel.

8. The rotary engine, as recited in claim 1, further comprising a fuel injector provided in the engine housing in a vicinity of said exhaust outlet within a gas feedback channel.

* * * * *